US005359264A

United States Patent [19]

Butler et al.

[11] Patent Number: 5,359,264

[45] Date of Patent: Oct. 25, 1994

[54] INTEGRAL IMPEDANCE MATCHING STRUCTURE FOR ELECTRODELESS DISCHARGE LAMP

[75] Inventors: Scott J. Butler, North Oxford; Walter P. Lapatovich, Marlborough, both of Mass.; Jason R. Bochinski, Springfield, Oreg.

[73] Assignee: GTE Products Corporation, Danvers, Mass.

[21] Appl. No.: 993,343

[22] Filed: Dec. 18, 1992

[51] Int. Cl.[5] ..... H05B 41/24

[52] U.S. Cl. ..... 315/248; 315/39; 315/344

[58] Field of Search ..... 315/39, 248, 344; 313/234

[56] References Cited

U.S. PATENT DOCUMENTS 5,070,277 12/1991 Lapatovich ..... 315/39 X
5,113,121 5/1992 Lapatovich et al. ..... 315/39 X
5,144,206 9/1992 Butler et al. ..... 315/39 X

OTHER PUBLICATIONS

"Feedback in Two-Port Networks", Dr. Archie K. McCurdy, pp. 1-22, date: 1977.

*Primary Examiner*—David Mis
*Attorney, Agent, or Firm*—Carlo S. Bessone

[57] ABSTRACT

An assembly includes an electrodeless discharge lamp disposed between a pair of field applicators, and an integral impedance matching structure for matching the impedance of the lamp and field applicators to the impedance of a power source. The structure includes a Tee junction, a transmission line including a first branch connecting a first output of the Tee junction to one of the field applicators. A second branch of the transmission line connects a second output of the Tee junction to the other field applicator. The difference between electrical lengths of the first and second branches are substantially shorter than a half-wavelength. The assembly is less complex and more compact than prior art which utilizes odd mode excitation via a half-wavelength balun transformer.

11 Claims, 2 Drawing Sheets

INTEGRAL IMPEDANCE MATCHING STRUCTURE FOR ELECTRODELESS DISCHARGE LAMP

FIELD OF THE INVENTION

The present invention relates to lamp coupling structures and, more particularly, to coupling structures providing impedance matching to an electrodeless high intensity discharge (HID) lamp.

BACKGROUND OF THE INVENTION

Microwave electrodeless high intensity discharge (HID) lamps have been electromagnetically coupled to power sources using termination fixtures which were typically large, bulky shielded coaxial structures with undesirable optical characteristics. A dual ended excitation scheme disclosed in U.S. Pat. Nos. 5,113,121 and 5,070,277 has resulted in considerable reductions in size and weight as well as enhanced optical characteristics. Disadvantageously, these coupling structures require an external variable impedance matching means (e.g. a stub tuner) which is bulky and expensive. In U.S. Pat. No. 5,144,206, the external tuning means is replaced with an integral impedance matching network located on the same printed circuit board material as the balun/applicator.

OBJECTS OF THE INVENTION

It is an object of the present invention to obviate the above-noted and other disadvantages of the prior art.

It is a further object of the present invention to eliminate the need for a half-wave balun employed in the prior art by using a substantially shorter transmission line which serves as a reactive feedback element.

It is a further object of the present invention to provide a coupling structure which facilitates impedance matching to an electrodeless HID lamp.

It is a yet further object of the present invention to provide a feedback network integrally coupled to an HID lamp and applicator assembly.

SUMMARY OF THE INVENTION

The present invention relates to a network coupled to a lamp applicator assembly. The network comprises a reactive impedance means interconnected with said applicator assembly in a parallel-parallel feedback circuit configuration.

In one aspect of the present invention, the reactive impedance means comprises a transmission line.

DETAILED DESCRIPTION OF THE PREFERRED EMBODIMENTS

The present invention concerns the utilization of a reactive impedance component with all arbitrary load impedance, and the effect of such a component on the input impedance of a lamp fixture. The load impedance refers to a lumped element equivalent circuit representation of a lamp and applicator assembly.

Figure 1:
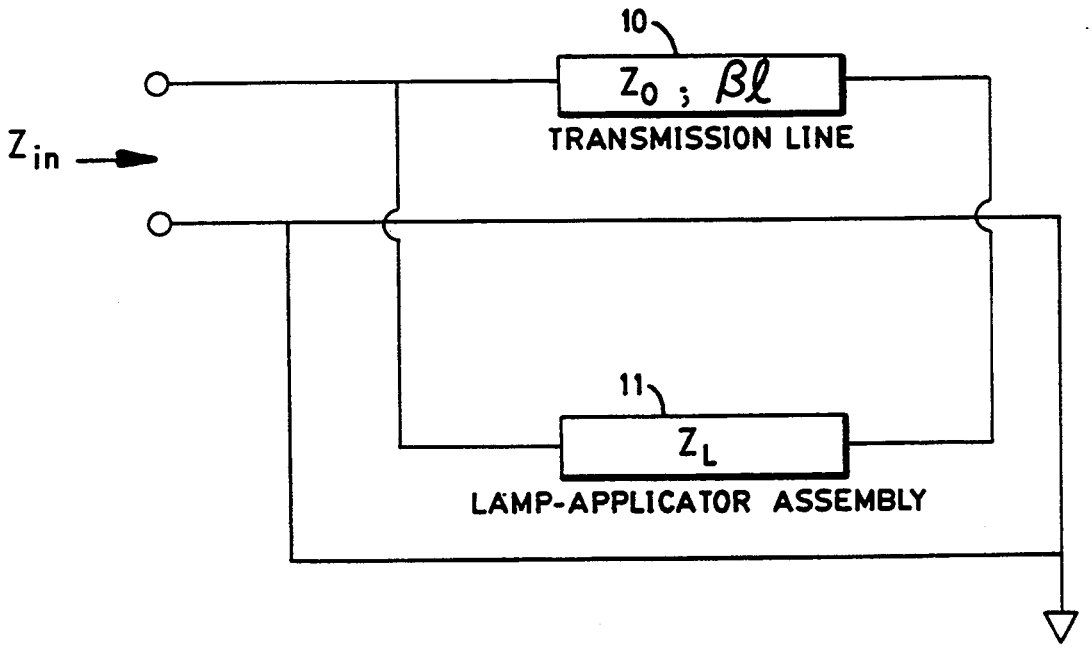
FIG. 1 schematically illustrates a coupling structure using a feedback network in accordance with the present invention.

FIG. 1 shows a circuit configuration according to the present invention. A reactive impedance component 10 is coupled to a lamp-applicator assembly 11 in a parallel-parallel feedback configuration. A wide range of transmission line lengths which do not function as baluns can be employed as reactive feedback matching components since the lamp and applicator assembly is substantially removed from ground, and the applicators are both low-loss and ineffective radiators.

In particular, since the principal source of loss in a lamp assembly is the discharge, and the field across the lamp is the important electromagnetic quantity, the relative amplitude and phase of the microwave signal with respect to ground at either end of the circuit structure is immaterial so long as an impedance match is maintained.

Accordingly, since the lamp and applicators can be treated as a floating (with respect to ground) serial impedance, impedance matching by means such as reactive feedback can be employed to provide the desired odd mode excitation. In the steady-state case, even-mode field components are unimportant provided that two conditions are satisfied, namely that the components are not reflected back to the input port or radiated into space. Since the impedance matching is optimized to eliminate the net reflection at the input, the first condition is met. Likewise, since the applicators used are ineffective radiators, the second condition is also met. This form of impedance matching can thus result in an on-board matching network which is substantially less complex (in terms of fabrication) and substantially more compact than the prior art which utilizes odd mode excitation via a half-wavelength 4:1 balun transformer.

As noted above, FIG. 1 illustrates a circuit design coupling a lossless transmission line to a lamp-applicator assembly (treated as a serial component with loss) in a parallel-parallel feedback configuration. This configuration results in an input impedance $Z_{in}$ which is a function of both the electrical length and characteristic impedance of the transmission line. The equation for the input impedance is computed using network theory applied to two dual-port networks, wherein one two-port network represents the lamp-applicator assembly while the other represents the reactive impedance feedback network (transmission line). An instructive text on network theory is disclosed by Dr. Archie N. McCurdy of Worcester Polytechnic Institute, Worcester, Mass. in "Feedback in Two-port Networks", pp. 1–22.

According to network theory for a parallel-parallel feedback configuration, the admittance matrix $[Y_T]$ of the entire network can be expressed as the summation of the admittance matrix $[Y_A]$ of the transmission line and the admittance matrix $[Y_L]$ of the serial load impedance (lamp and applicators):

$$[Y_T] = [Y_A] + [Y_L], \text{ where}$$

$$[Y_L] = \begin{bmatrix} Y_L & -Y_L \\ -Y_L & Y_L \end{bmatrix} \text{and}$$

$$[Y_A] = \begin{bmatrix} -j(\cot\beta l)/Z_o & +j(\csc\beta l)/Z_o \\ j(\csc\beta l)/Z_0 & -j(\cot\beta l)/Z_o \end{bmatrix}$$

A lossless transmission line is assumed for simplicity.

The value $Z_o$ represents the characteristic impedance of the transmission line and $\beta l$ is the electrical length of the transmission line, wherein $\beta$ is the propagation constant equalling $2\pi/\lambda_g$ and l is the physical length of the line. "$\lambda_g$ is the wavelength of propagation in the transmission line."

The input impedance is found with the following equations:

$$Z_{in}=Z_{11}=Y_{22}/\Delta Y=(Y_L-jY_o \cot \beta l)/\Delta Y;$$

and $$\Delta Y=Y_{11}Y_{22}-Y_{12}Y_{21}=Y_o^2-j2Y_oY_L(\cot \beta l-csc\beta l).$$

Thus, $$Z_{in}=(Y_L-jY_o \cot \beta l)/[Y_o^2-j2Y_oY_L(\cot \beta-csc\beta l)],$$

and $$Z_{in}=[1+j(Z_o/Z_L) \tan \beta l]/[(2/Z_L)-(2/Z_L) \sin \beta l+j(\tan \beta l/Z_o)].$$

At $\beta l=\pi/2$, for example, the input impedance reduces to $Z_{in}=Z_o^2/(Z_L+j2Z_o)$. If $Z_L=R_L-jX_L$, then $Z_{in}=R_o^2/[R_L-j(X_L-2R_o)]$ and $Y_{in}=[R_L/R_o^2]-j[(X_L-2R_o)/R_o^2]=G_{in}-jB_{in}$. These equations suggest that if $R_LR_o^21/50$, complete impedance matching may be accomplished with the addition of a shunt capacitor or inductor at the input, such as a varactor or pin-diode to provide a smart ballast capability. As the above equations suggest, any value of $Z_{in}$ is possible by selecting a transmission line with the appropriate parameters, namely $\beta l$ and $Z_o$.

Figure 2:
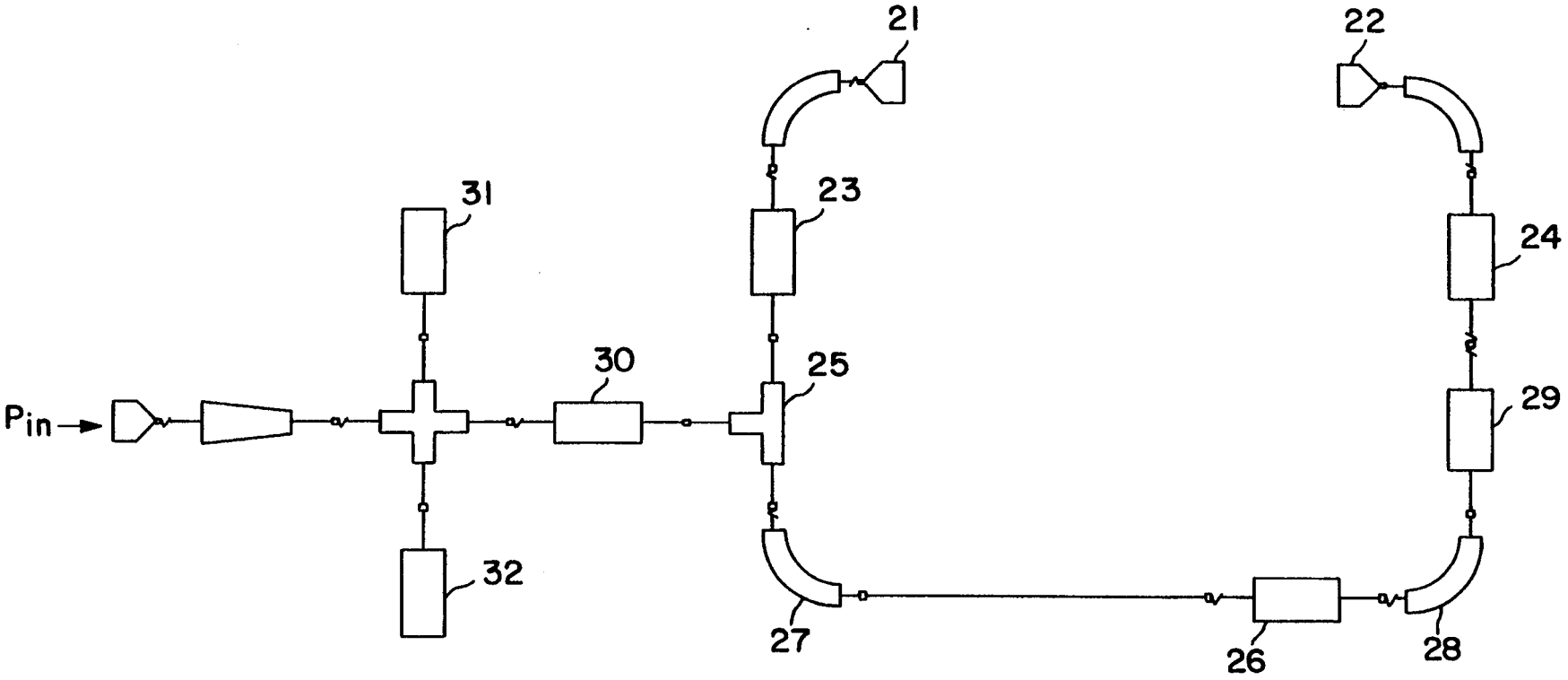
FIG. 2 shows one embodiment of the coupling structure in FIG. 1.

FIG. 2 schematically illustrates one embodiment of the present invention. Applicators 21 and 22 are slow-wave helical coils which define the opposite ends of a gap where an electrodeless HID lamp is placed. The coupling structure for the lamp-applicator assembly includes a first branch extending from one arm of a well-defined Tee junction 25 to applicator 21, and a second branch extending from the second arm of junction 25 to applicator 22.

In accordance with the present invention, the integral impedance matching coupling structure utilizes a relatively high impedance (=80Ω) microstrip reactive feedback transmission line network which is substantially shorter than a half-wavelength. In particular, the transmission line network includes two microstrip transmission-line segments 23 and 24, wherein the differential length of the segments 23 and 24 from Tee junction 25 to the helical applicators is on the order of 1/6th of one wavelength. The coupling structure provides a nominal steady-state input impedance of 50Ω, thereby allowing direct connection via conventional transmission line techniques to a 915 MHz power source.

In order to balance out the end effects associated with the dual-ended coupling of applicators 21 and 22, a length of microstrip transmission-line 26 (serving as a delay line) is inserted along with the microstrip Tee junction 25. A coupling structure utilizing the Tee-junction and delay line is disclosed in a copending application, herein incorporated by reference, entitled "Apparatus for Coupling Energy to Electrodeless Lamp Applicators," filed Aug. 14, 1992 as Ser. No. 07/930,127 now U.S. Pat. No. 5,280,217 by inventors common to the present application, and assigned to the same assignee as the present application. In the fabricated coupling structure, the actual delay is provided by the delay section comprising the transmission line 26, curves 27 and 28, and microstrip line 29.

The delay line and Tee junction improve symmetry and decouple parasitic reactances associated with microstrip discontinuities. Accordingly, since the discontinuities associated with both transmission line junctions and the microstrip-applicator transition result in significant unconfigured parasitics (especially stray capacitances which can interact with other nearby discontinuities), the decoupling of the parasitics allows more accurate modeling of the integral matching microstrip network. At the input end of the network, microwave power $P_{in}$ is applied, and a short length of 50Ω microstrip 30 is included with a pair of low impedance open circuit stubs 31 and 32 to provide further impedance matching.

The components shown in the schematic of FIG. 2 have the following geometric characteristics:

| Length (mils) | |
|---|---|
| Transmission lines 23 and 24 | 11.06 |
| Delay line 26 | 902 |
| 50Ω line 30 | 125.12 |
| Stubs 31 and 32 | 339.1. |

The width of the microstrip lines is 76.12 mils, while the width of the stubs is 395.6. The microstrip printed circuit structure is comprised of copper clad, teflon-fiberglass with a relative dielectric constant of 2.55 and thickness of 60 mils. The lumped circuit representation of the applicators 21,22 and HID lamp is a serial load impedance comprising a 50Ω resistor with two 1.42 pF capacitors.

This network was optimized using computer aided analysis (Touchstone, for example) based upon measured impedance data derived using the half-wave balun technique for a matrix of electrodeless HID lamp capsules (2 mm ID, 3 mm OD approximately 10 mm long). Typical 915 MHz return loss performance is approximately 16 dB at 25 W with a luminous output of approximately 3000 lumens (=120 LPW).

Although the circuit configuration in FIG. 2 illustrates a specific implementation of the present invention, it should be obvious to those skilled in the art that various modifications can be made without departing from the scope of the invention. For example, this network could support other allowed Industrial Scientific and Medical (ISM) frequencies such as 13.56 MHZ, 40.7 MHZ, 2.45 GHZ, 5.8 GHZ and 24.125 GHZ, or any other frequency outside the ISM band with the appropriate circuit components.

Furthermore, while the network was constructed in planar transmission media such as microstrip, stripline, or slabline, one skilled in the art could employ coaxial cable, waveguide, twinline, dielectric guides, or other suitable media. Additionally, the applicator assembly may include end cups, hairpins or loops, or other dual-ended excitation structures, and may be constructed of metal, metallic alloys, or high temperature superconducting alloys such as YBCO. Lamp structures other than an electrodeless HID fixture may also be used, including but not limited to low pressure fluorescent microwave powered lamps as well as low pressure inert gas discharge lamps.

The configuration of the delay section is variably adjustable to generate a design which maximizes the power transfer to the load. For example, other delay line segments may be added, and the geometries of the delay lines varied. Additionally, although the FIG. 2 coupling structure is matched to a 50Ω impedance, other system impedances may be accommodated. In general, interstage matching networks may be used in conjunction with the present invention to facilitate matching with the output impedance of any active power source electronic device.

While there has been shown what are at present considered to be the preferred embodiments of the invention, various modifications and alterations will be obvious to those skilled in the art. All such modifications are intended to fall within the scope of the appended claims.

What is claimed is:

1. An assembly having an input impedance comprising: first and second field applicators oriented to define a gap therebetween;

an electrodeless discharge lamp disposed in said gap between said first and second field applicators, said field applicators and said electrodeless lamp having an effective series impedance, an integral impedance matching structure for electromagnetically coupling energy from a power source to said electrodeless discharge lamp, said integral impedance matching structure comprising:

a Tee junction having first and second outputs; and a transmission line including a first branch having a predetermined effective electrical length connecting said first output of said Tee junction to said first field applicator and a second branch having a predetermined electrical length connecting said second output of said Tee junction to said second field applicator, the difference between said predetermined electrical lengths of said first and second branches being substantially shorter than a half-wavelength.

2. The assembly of claim 1 wherein the difference between said predetermined electrical lengths of said first and second branches is on the order of 1/6th of one wavelength.

3. The assembly of claim 1 wherein said input impedance equals:

$$Z_{in} = \frac{1 + j(Z_o/Z_L)\tan\beta l}{(2/Z_L) - (2/Z_L)\sin\beta l + j(\tan\beta l/Z_o)};$$

wherein $Z_o$ represents said characteristic impedance of said transmission line;

$Z_L$ represents said effective series impedance of said applicators and said electrodeless lamp; and $\beta l$ represents said effective electrical length of said transmission line, wherein $\beta = 2\pi/\lambda_g$, $\lambda_g$ is a wavelength of propagation in said transmission line, and l is a physical length of said transmission line.

4. The assembly of claim 1 wherein said transmission line has an impedance equal to 80Ω.

5. The assembly of claim 1 wherein said input impedance $Z_{in}$ is equal to about 50Ω.

6. The assembly of claim 1 further including a matching network electrically coupled between said power source and said input of said Tee junction.

7. The assembly of claim 6 wherein said matching network includes a pair of open circuit stubs connected to a second transmission line.

8. The assembly of claim 7 wherein said second transmission line has an impedance of 50Ω.

9. The assembly of claim 1 wherein said power source has a frequency in an ISM frequency band including 13.56 MHZ, 40.7 MHZ, 915 MHz, 2.45 GHZ, 5.8 GHZ and 24.125 GHZ.

10. The assembly of claim 1 wherein said transmission line includes microstrip, stripline, or slabline.

11. The assembly of claim 1 wherein said electrodeless discharge lamp is an HID lamp.

* * * * *